US005415737A

United States Patent [19]

Phan et al.

[11] Patent Number: 5,415,737

[45] Date of Patent: May 16, 1995

[54] PAPER PRODUCTS CONTAINING A BIODEGRADABLE VEGETABLE OIL BASED CHEMICAL SOFTENING COMPOSITION

[75] Inventors: Dean V. Phan, West Chester; Paul D. Trokhan, Hamilton, both of Ohio

[73] Assignee: The Procter & Gamble Company, Cincinnati, Ohio

[21] Appl. No.: 309,993

[22] Filed: Sep. 20, 1994

[51] Int. Cl.[6] ..... D21H 21/22

[52] U.S. Cl. ..... 162/111; 162/112; 162/158; 162/179

[58] Field of Search ..... 162/111, 112, 113, 158, 162/179

[56] References Cited

U.S. PATENT DOCUMENTS

| | | | |
|---|---|---|---|
| 2,683,087 | 7/1954 | Reynolds, Jr. | 162/158 |
| 2,683,088 | 7/1954 | Reynolds, Jr. | 162/158 |
| 3,301,746 | 1/1967 | Sanford et al. | 162/113 |
| 3,395,708 | 8/1968 | Hervey et al. | 162/179 |
| 3,554,862 | 1/1971 | Hervey et al. | 162/158 |
| 3,554,863 | 1/1971 | Hervey et al. | 162/158 |
| 3,755,220 | 8/1973 | Freimark et al. | 260/17.3 |
| 3,812,000 | 5/1974 | Salvucci et al. | 162/111 |
| 3,817,827 | 6/1974 | Benz | 162/113 |
| 3,844,880 | 10/1974 | Meisel, Jr. et al. | 162/169 |
| 3,974,025 | 8/1976 | Ayers | 162/113 |
| 3,994,771 | 11/1976 | Morgan, Jr. et al. | 162/113 |
| 4,144,122 | 3/1979 | Emanuelsson et al. | 162/158 |
| 4,158,594 | 6/1979 | Becker et al. | 162/112 |
| 4,191,609 | 3/1980 | Trokhan | 162/113 |
| 4,300,981 | 11/1981 | Carstens | 162/109 |
| 4,303,471 | 12/1981 | Laursen | 162/158 |
| 4,351,699 | 9/1982 | Osborn | 162/158 |
| 4,377,543 | 3/1983 | Strohbeen et al. | 264/120 |
| 4,425,186 | 1/1984 | May et al. | 162/179 |
| 4,432,833 | 2/1984 | Breese | 162/158 |
| 4,441,962 | 4/1984 | Osborn, III | 162/111 |
| 4,447,294 | 5/1984 | Osborn,III | 162/158 |
| 4,529,480 | 7/1985 | Trokhan | 162/109 |
| 4,637,859 | 1/1987 | Trokhan | 162/109 |
| 4,795,530 | 1/1989 | Soerens et al. | 162/111 |
| 4,853,086 | 8/1989 | Graef | 162/157.6 |
| 4,940,513 | 7/1990 | Spendel | 162/112 |
| 4,959,125 | 9/1990 | Spendel | 162/158 |
| 4,981,557 | 1/1991 | Bjorkquist | 162/168.2 |
| 5,066,414 | 11/1991 | Chang | 252/8.8 |
| 5,217,576 | 6/1993 | Phan | 162/158 |
| 5,223,096 | 6/1993 | Phan et al. | 162/158 |
| 5,240,562 | 8/1993 | Phan et al. | 162/158 |
| 5,262,007 | 11/1993 | Phan et al. | 162/158 |
| 5,264,082 | 11/1993 | Phan et al. | 162/111 |
| 5,279,767 | 1/1994 | Phan et al. | 252/357 |
| 5,312,522 | 5/1994 | Phan et al. | 162/111 |

FOREIGN PATENT DOCUMENTS

| | | |
|---|---|---|
| 61-308312 | 7/1988 | Japan . |
| 4-100995 | 4/1992 | Japan . |

*Primary Examiner*—Peter Chin
*Attorney, Agent, or Firm*—Bart S. Hersko; E. Kelly Linman; Jacobus C. Rasser

[57] ABSTRACT

Fibrous cellulose materials useful in the manufacture of soft, absorbent paper products such as paper towels, facial tissues, and toilet tissue are disclosed. The paper products contain a biodegradable vegetable oil based ester-functional quaternary ammonium chemical softening compound. Examples of preferred vegetable oil based ester-functional quaternary ammonium chemical softening compounds include diester dioleyldimethyl ammonium chloride (DEDODMAC) (i.e., di(octadec-z-9-oenoyloxyethyl)dimethylammonium chloride) and diester dierucyldimethyl ammonium chloride (DEDEDMAC) (i.e., di(docos-z-13-enoyloxyethyl)-dimethylammonium chloride). Depending upon the paper product characteristic requirements, the saturation level of the fatty acyl groups of the vegetable oils can be tailored. Variables that need to be adjusted to maximize the benefits of using unsaturated vegetable oil based acyl groups include the Iodine Value (IV) of the fatty acyl groups; and the cis/trans isomer weight ratios in the fatty acyl groups.

24 Claims, No Drawings

PAPER PRODUCTS CONTAINING A BIODEGRADABLE VEGETABLE OIL BASED CHEMICAL SOFTENING COMPOSITION

FIELD OF THE INVENTION

This invention relates to tissue paper webs. More particularly, it relates to soft, absorbent tissue paper webs which can be used in paper towels, napkins, facial tissues, and toilet tissue products.

BACKGROUND OF THE INVENTION

Paper webs or sheets, sometimes called tissue or paper tissue webs or sheets, find extensive use in modern society. Such items as paper towels, napkins, facial and toilet tissues are staple items of commerce. It has long been recognized that three important physical attributes of these products are their softness; their absorbency, particularly their absorbency for aqueous systems; and their strength, particularly their strength when wet. Research and development efforts have been directed to the improvement of each of these attributes without seriously affecting the others as well as to the improvement of two or three attributes simultaneously.

Softness is the tactile sensation perceived by the consumer as he/she holds a particular product, rubs it across his/her skin, or crumples it within his/her hand. This tactile sensation is a combination of several physical properties. One of the more important physical properties related to softness is generally considered by those skilled in the art to be the stiffness of the paper web from which the product is made. Stiffness, in turn, is usually considered to be directly dependent on the dry tensile strength of the web and the stiffness of the fibers which make up the web.

Strength is the ability of the product, and its constituent webs, to maintain physical integrity and to resist tearing, bursting, and shredding under use conditions, particularly when wet.

Absorbency is the measure of the ability of a product, and its constituent webs, to absorb quantities of liquid, particularly aqueous solutions or dispersions. Overall absorbency as perceived by the human consumer is generally considered to be a combination of the total quantity of liquid a given mass of tissue paper will absorb at saturation as well as the rate at which the mass absorbs the liquid.

The use of wet strength resins to enhance the strength of a paper web is widely known. For example, Westfelt described a number of such materials and discussed their chemistry in Cellulose Chemistry and Technology, Volume 13, at pages 813–825 (1979). Freimark et al. in U.S. Pat. No. 3,755,220 issued Aug. 28, 1973 mention that certain chemical additives known as debonding agents interfere with the natural fiber-to-fiber bonding that occurs during sheet formation in papermaking processes. This reduction in bonding leads to a softer, or less harsh, sheet of paper. Freimark et al. go on to teach the use of wet strength resins to enhance the wet strength of the sheet in conjunction with the use of debonding agents to off-set undesirable effects of the wet strength resin. These debonding agents do reduce dry tensile strength, but there is also generally a reduction in wet tensile strength.

Shaw, in U.S. Pat. No. 3,821,068, issued Jun. 28, 1974, also teaches that chemical debonders can be used to reduce the stiffness, and thus enhance the softness, of a tissue paper web.

Chemical debonding agents have been disclosed in various references such as U.S. Pat. No. 3,554,862, issued to Hervey et al. on Jan. 12, 1971. These materials include quaternary ammonium salts such as trimethylcocoammonium chloride, trimethyloleylammonium chloride, di(hydrogenated) tallow dimethyl ammonium chloride and trimethylstearyl ammonium chloride.

Emanuelsson et al., in U.S. Pat. No. 4,144,122, issued Mar. 13, 1979, teach the use of complex quaternary ammonium compounds such as bis(alkoxy(2-hydroxy)-propylene) quaternary ammonium chlorides to soften webs. These authors also attempt to overcome any decrease in absorbency caused by the debonders through the use of nonionic surfactants such as ethylene oxide and propylene oxide adducts of fatty alcohols.

Armak Company, of Chicago, Ill., in their bulletin 76-17 (1977) disclose that the use of dimethyl di(hydrogenated) tallow ammonium chloride in combination with fatty acid esters of polyoxyethylene glycols may impart both softness and absorbency to tissue paper webs.

One exemplary result of research directed toward improved paper webs is described in U.S. Pat. No. 3,301,746, issued to Sanford and Sisson on Jan. 31, 1967. Despite the high quality of paper webs made by the process described in this patent, and despite the commercial success of products formed from these webs, research efforts directed to finding improved products have continued.

For example, Becker et al. in U.S. Pat. No. 4,158,594, issued Jan. 19, 1979, describe a method they contend will form a strong, soft, fibrous sheet. More specifically, they teach that the strength of a tissue paper web (which may have been softened by the addition of chemical debonding agents) can be enhanced by adhering, during processing, one surface of the web to a creping surface in a fine patterned arrangement by a bonding material (such as an acrylic latex rubber emulsion, a water soluble resin, or an elastomeric bonding material) which has been adhered to one surface of the web and to the creping surface in the fine patterned arrangement, and creping the web from the creping surface to form a sheet material.

Conventional quaternary ammonium compounds such as the well known dialkyl dimethyl ammonium salts (e.g. ditallow dimethyl ammonium chloride, ditallow dimethyl ammonium methyl sulfate, di(hydrogenated) tallow dimethyl ammonium chloride etc.) are effective chemical softening agents. The mono- and di-ester variations of these quaternary ammonium salts have been proven to be environmental friendly and also function effectively as chemical softening agents for enhancing the softness of fibrous cellulose materials. Unfortunately, these quaternary ammonium compounds can be subject to odor problems and can also be difficult to disperse. Applicants has discovered that the vegetable oil based mono- and di-ester of the quaternary ammonium salts also function effectively as chemical softening agents for enhancing the softness of fibrous cellulose materials. Tissue paper made with vegetable oil based mono- and di-ester quat softeners exhibited good softness and absorbency with improved odor compared to tissue made with animal based mono- and di-ester quat softeners. In addition, due to the good fluidity (low melting points) of the vegetable oil based mono- and di-ester quat softeners, good dispersion with minimum or without diluant usage can be achieved.

It is an object of this invention to provide a soft, absorbent toilet tissue paper products.

It is an object of this invention to provide a soft, absorbent facial tissue paper products.

It is an object of this invention to provide soft, absorbent towel paper products.

It is also a further object of this invention to provide a process for making soft, absorbent tissue (i.e., facial and/or toilet tissue) and paper towel products.

These and other objects are obtained using the present invention, as will become readily apparent from a reading of the following disclosure.

SUMMARY OF THE INVENTION

The present invention provides soft, absorbent paper products.

Briefly, the soft paper products comprise:

(a) cellulose paper making fibers; and (b) from about 0.005% to about 5.0% by weight of said cellulose paper making fibers of a biodegradable ester-functional quaternary ammonium softening compound having the formula:

$$(R)_{4-m}-N^{+}-[(CH_2)_n-Y-R^2]_m\ X^-$$

wherein each Y is —O—(O)C—, or —C(O)—O—;

m is 1 to 3;

n is 1 to 4;

each R is a $C_1$-$C_6$ alkyl group, hydroxyalkyl group, hydrocarbyl group, substituted hydrocarbyl group, benzyl group, or mixtures thereof;

each $R^2$ is a $C_{11}$-$C_{23}$ hydrocarbyl or substituted hydrocarbyl substituent; and $X^-$ is any softener-compatible anion;

wherein the $R^2$ portion of the softening compound is derived from $C_{12}$-$C_{24}$ fatty acyl groups having an Iodine Value of from greater than about 5 to less than about 100. Preferably, the majority of the fatty acyl groups are derived from vegetable oil sources.

Preferably, the biodegradable ester-functional quaternary ammonium compound is diluted with a liquid carrier to a concentration of from about 0.01% to about 25.0%, by weight, before being added to the fibrous cellulose material. Preferably, the temperature of the liquid carrier ranges from about 30° C. to about 60° C. and the pH is less than about 4. Preferably, at least 20% of the biodegradable ester-functional quaternary ammonium compounds added to the fibrous cellulose are retained.

Examples of preferred quaternized ester-amine compounds suitable for use in the present invention include compounds having the formulas:

$$(CH_3)_2-N^{+}-(CH_2CH_2-O-\overset{\overset{\displaystyle O}{\|}}{C}-C_{17}H_{33})_2\quad X^-$$

and $$(CH_3)_2-N^{+}-(CH_2CH_2-O-\overset{\overset{\displaystyle O}{\|}}{C}-C_{21}H_{41})_2\quad X^-$$

These compounds can be considered to be mono and di-ester variations of the diester dioleyldimethyl ammonium chloride (DEDODMAC) (i.e., di(octadec-z-9-enoyloxyethyl)dimethylammonium chloride) and diester dierucyldimethyl ammonium chloride (DEDEDMAC) (i.e., di(docos-z-13-enoyloxyethyl)dimethylammonium chloride) respectively. It's to be understood that because the oleyl and the erucyl fatty acyl groups are derived from naturally occurring vegetable oils (e.g., olive oil, rapeseed oil etc.), that minor amounts of other fatty acyl groups may also be present. For a discussion of the variable compositions of naturally occurring vegetable oils see Bailey's Industrial Oil and Fat Products, Third Edition, John Wiley and Sons (New York 1964), incorporated herein by reference. Depending upon the product characteristic requirements, the saturation level of the fatty acyl groups of the vegetable oils can be tailored.

Briefly, the process for making the tissue webs of the present invention comprises the steps of formation is a papermaking furnish from the aforementioned components, deposition of the papermaking furnish onto a foraminous surface such as a Fourdrinier wire, and removal of the water from the deposited furnish.

All percentages, ratios and proportions herein are by weight unless otherwise specified.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the terms tissue paper web, paper web, web, paper sheet and paper product all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an aqueous papermaking furnish is an aqueous slurry of papermaking fibers and the chemicals described hereinafter.

The first step in the process of this invention is the forming of an aqueous papermaking furnish. The furnish comprises papermaking fibers (hereinafter sometimes referred to as wood pulp), and at least one vegetable oil based quaternized ester-amine compound, all of which will be hereinafter described.

It is anticipated that wood pulp in all its varieties will normally comprise the papermaking fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and chemically modified thermomechanical pulp (CTMP). Pulps derived from both deciduous and coniferous trees can be used. Also applicable to the present invention are fibers derived from recycled paper, which may contain any or all of the above categories as well as other non-fibrous materials such as fillers and adhesives used to facilitate the original papermaking. Preferably, the papermaking fibers used in this invention comprise Kraft pulp derived from northern softwoods.

(A) Biodegradable ester-functional quaternary ammonium compound

The present invention contains as an essential component from about 0.005% to about 5.0%, more preferably from about 0.03% to about 0.5% by weight, on a dry fiber basis of an biodegradable ester-functional quaternary ammonium compound having the formula:

$$(R)_{4-m}-N^{+}-[(CH_2)_n-Y-R^2]_m X^-$$

wherein m=1 to 3; preferably, m=2;

each n=1 to 4; preferably, n=2;

each R substituent is a short chain $C_1$-$C_6$, preferably $C_1$-$C_3$, alkyl group, e.g., methyl (most preferred), ethyl, propyl, and the like, hydroxyalkyl group, hydrocarbyl group, substituted hydrocarbyl group, benzyl group or mixtures thereof;

each $R^2$ is a long chain, at least partially unsaturated (IV of greater than about 5 to less than about 100, preferably from about 10 to about 85), $C_{11}$-$C_{23}$ hydrocarbyl, or substituted hydrocarbyl substituent and the counter-ion, $X^-$, can be any softener-compatible anion, for example, acetate, chloride, bromide, methylsulfate, formate, sulfate, nitrate and the like.

Preferably, the majority of $R^2$ comprises fatty acyls containing at least 90% $C_{18}$-$C_{24}$ chainlength. More preferably, the majority of $R^2$ is selected from the group consisting of fatty acyls containing at least 90% $C_{18}$, $C_{22}$ and mixtures thereof.

The biodegradable ester-functional quaternary ammonium compound prepared with fully saturated acyl groups are rapidly biodegradable and excellent softeners. However, it has now been discovered that compounds prepared with at least partially unsaturated acyl groups (i.e., IV of greater than about 5 to less than about 100, preferably less than about 85, more preferably from about 10 to about 85) derived from vegetable oil sources have many advantages (such as better fluidity) and are highly acceptable for consumer products when certain conditions are met.

Variables that must be adjusted to obtain the benefits of using unsaturated acyl groups include the Iodine Value (IV) of the fatty acyl groups; the cis/trans isomer weight ratios in the fatty acyl groups. Any reference to IV values hereinafter refers to IV (Iodine Value) of fatty acyl groups and not to the resulting biodegradable ester-functional quaternary ammonium compound.

Preferably, these biodegradable ester-functional quaternary ammonium compounds are made from fatty acyl groups having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature. These cis/trans isomer weight ratios provide optimal concentratability at these IV ranges. In the IV range above about 25, the ratio of cis to trans isomers is less important unless higher concentrations are needed. The relationship between IV and concentratability is described hereinafter.

Generally, hydrogenation of fatty acids to reduce polyunsaturation and to lower IV to insure good color leads to a high degree of trans configuration in the molecule. Therefore, ester-functional quaternary ammonium compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 30%, preferably less than about 10%, more preferably less than about 5%. As used herein, these polyunsaturation percentages refer to the number of fatty acid (or fatty acyl) groups that are polyunsaturated per 100 groups. During touch hardening the cis/trans isomer weight ratios are controlled by methods known in the art such as by optimal mixing, using specific catalysts, providing high $H_2$ availability, etc.

It has also been found that for good hydrolytic stability of the biodegradable ester-functional quaternary ammonium compound in molten storage, moisture level in the raw material must be controlled and minimized preferably less than about 1% and more preferably less than about 0.5% water. Storage temperatures should be kept low as possible and still maintain a fluid material, ideally in the range of from about 120° F. to about 150° F. The optimum storage temperature for stability and fluidity depends on the specific IV of the fatty acid used to make the ester-functional quaternary ammonium compound and the level/type of solvent selected. It is important to provide good molten storage stability to provide a commercially feasible raw material that will not degrade noticeably in the normal transportation/storage/handling of the material in manufacturing operations.

Synthesis of a biodegradable ester-functional quaternary ammonium compound

Synthesis of a preferred biodegradable ester-functional quaternary ammonium compound used herein can be accomplished by the following two-step process:

Step A. Synthesis of Amine

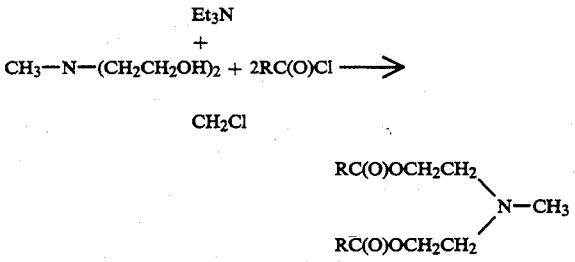

RC(O) = Derived from oelic acids or erucic acids.

Amine

N-Methyldiethanolamine (440.9 g, 3.69 mol) and triethylamine (561.2 g, 5.54 mol) are dissolved in $CH_2Cl_2$ (12 L) in a 22 L 3-necked flask equipped with an addition funnel, thermometer, mechanical stirrer, condenser, and an argon sweep. The vegetable oil based fatty acid chloride (2.13 kg, 7.39 mol) is dissolved in 2 L $CH_2Cl_2$ and added slowly to the amine solution. The amine solution is then heated to 35° C. to keep the fatty acyl chloride in solution as it is added. The addition of the acid chloride increased the reaction temperature to reflux (40° C). The acid chloride addition is slow enough to maintain reflux but not so fast as to lose methylene chloride out of the top of the condenser. The addition should take place over 1.5 hours. The solution is heated at reflux an additional 3 hours. The heat is removed and the reaction stirred 2 hours to cool to room temperature. $CHCl_3$ (12 L) is added. This solution is washed with 1 gallon of saturated NaCl and 1 gallon of saturated $Ca(OH)_2$. The organic layer is allowed to set overnight at room temperature. It is then extracted three times with 50% $K_2CO_3$ (2 gal. each). This is followed by 2 saturated NaCl washes (2 gal. each). Any emulsion that formed during these extractions is resolved by addition of $CHCl_3$ and/or saturated salt and heating on a steam bath. The organic layer is then dried with $MgSO_4$, filtered and concentrated down. Yield is 2.266 kg of the oelyl or erucyl precursor amine ester-functional. TLC silica (75% $Et_2O$/25% hexane one spot at Rf 0.69).

Step B. Quaternization $$\text{Amine ester-functional} + CH_3Cl \xrightarrow{CH_3CN} (CH)_2N^+(CH_2CH_2O(O)CR)_2\ Cl^-$$

The oleyl/erucyl precursor amine (2.166 kg, 3.47 mol) is heated on a steam bath with $CH_3CN$ (1 gal.) until it becomes fluid. The mixture is then poured into a 10 gal., glass-lined, stirred Pfaudler reactor containing $CH_3CN$ (4 gal.). $CH_3Cl$ (25 lbs., liquid) was added via a tube and the reaction is heated to 80° C. for 6 hours. The $CH_3CN$/amine solution is removed from the reactor, filtered and the solid allowed to dry at room temperature over the weekend. The flitrate is roto-evaporated down, allowed to air dry overnight and combined with the other solid. Yield: 2.125 kg white powder.

The biodegradable ester-functional quaternary ammonium compounds can also be synthesized by other processes:

$$(CH_3)-N-(CH_2CH_2OH)_2 + 2ClC(O)C_{21}H_{41} \xrightarrow{(C_2H_5)_3N} CH_3-N-[CH_2CH_2OC(O)C_{21}H_{41}]_2$$

0.6 mole of diethanol methyl amine is placed in a 3-liter, 3-necked flask equipped with a reflux condenser, argon (or nitrogen) inlet and two addition funnels. In one addition funnel is placed 0.4 moles of triethylamine in the second addition funnel is placed 1.2 moles of erucyl chloride in a 1:1 solution with methylene chloride. Methylene chloride (750 mL) is added to the reaction flask containing the amine and heated to 35° C. (water bath). The triethylamine is added dropwise, and the temperature is raised to 40°–45° C. while stirring over one-half hour. The erucyl chloride/methylene chloride solution is added dropwise and allowed to heat at 40°–45° C. under inert atmosphere overnight (12–16 h).

The reaction mixture is cooled to room temperature and diluted with chloroform (1500 mL). The chloroform solution of product is placed in a separatory funnel (4 L) and washed with saturated NaCl, diluted $Ca(OH)_2$, 50% $K_2CO_3$ (3 times)*, and, finally, saturated NaCl. The organic layer is collected and dried over $MgSO_4$, filtered and solvents are removed via rotary evaporation. Final drying is done under high vacuum (0.25 mm Hg).

*Note: The 50% $K_2CO_3$ layer will be below the chloroform layer.

Step B. Quaternization $$CH_3-N-[CH_2CH_2OC(O)C_{21}H_{41}]_2 \xrightarrow{CH_3Cl} (CH3)_2-N^+-[CH_2CH_2OC(O)C_{21}H_{41}]_2\ Cl^-$$

0.5 moles of the methyl diethanol eruciate amine from Step A is placed in an autoclave sleeve along with 200–300 mL of acetonitrile (anhydrous). The sample is then inserted into the autoclave and purged three times with $N_2$ (16275 mm Hg/21.4 ATM) and once with $CH_3Cl$. The reaction is heated to 80° C. under a pressure of 3604 mm Hg/4.7 ATM in $CH_3Cl$ for 24 hours. The autoclave sleeve is then removed from the reaction mixture. The sample is dissolved in chloroform and solvent is removed by rotary evaporation, followed by drying on high vacuum (0.25 mm Hg).

Another process by which the preferred biodegradable ester-functional quaternary ammonium compounds can be made commercially is the reaction of fatty acids (e.g., oleic acids, erucic acids etc.) with methyl diethanolamine. Well known reaction methods are used to form the amine ester-functional precursor. The ester-functional quaternary is then formed by reaction with methyl chloride as previously discussed.

The above reaction processes are generally known in the art for the production of ester-functional quaternary ammonium softening compounds. To achieve the IV, cis/trans ratios, and percentage unsaturation outlined above, usually additional modifications to these processes must be made.

Several types of the vegetable oils (e.g., olive, rapeseed, safflower, sunflower, soya, meadow foam, etc.) can be used as sources of fatty acids to synthesize the biodegradable ester-functional quaternary ammonium compound. Preferably, olive oils, meadow foam, high oleic safflower, and/or high erucic rapeseed oils are used to synthesize the biodegradable ester-functional quaternary ammonium compound. Most preferably, the high erucic acids derived from rapeseed oils are used to synthesize the biodegradable ester-functional quaternary ammonium compound. It's to be understood that because the fatty acyl groups are derived from naturally occurring vegetable oils (e.g., olive oil, rapeseed oil etc.), that minor amounts of other fatty acyl groups may also be present. For a discussion of the variable compositions of naturally occurring vegetable oils see Bailey's Industrial Oil and Fat Products, Third Edition, John Wiley and Sons (New York 1964), incorporated herein by reference.

Importantly, it has been discovered that the vegetable oil based ester functional quaternary ammonium compounds of the present invention can be dispersed without the use of dispersing aids such as wetting agents. Without being bound by theory, it is believed that their superior dispersion properties is due to the good fluidity (low melting points) of the vegetable oils. This is in contrast to conventional animal fat based (e.g., tallow) quaternary ammonium compounds that require a dispersing aid due to their relatively high melting points. Vegetable oils also provide improved oxidative and hydrolytic stability. In addition, tissue paper made with the biodegradable vegetable oil based softeners exhibit good softness and absorbency with improved odor characteristics compared to tissue paper made with animal based softeners.

The present invention is applicable to tissue paper in general, including but not limited to conventionally felt-pressed tissue paper; pattern densified tissue paper such as exemplified in the aforementioned U.S. Patent by Sanford-Sisson and its progeny; and high bulk, uncompacted tissue paper such as exemplified by U.S. Pat. No. 3,812,000, Salvucci, Jr., issued May 21, 1974. The tissue paper may be of a homogenous or multilayered construction; and tissue paper products made therefrom may be of a single-ply or multi-ply construction. Tissue structures formed from layered paper webs are described in U.S. Pat. No. 3,994,771, Morgan, Jr. et al. issued Nov. 30, 1976, and incorporated herein by reference. In general, a wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in tissue papermaking, upon one or more endless foraminous screens. The layers are subsequently combined to form a layered composite web. The layer web is subsequently caused to conform to the surface of an open mesh drying/imprinting fabric by the application of a fluid to force to the web and thereafter thermally predried on said fabric as part of a low density papermaking process. The layered web may be stratified with respect to fiber type or the fiber content of the respective layers may be essentially the same. The tissue paper preferably has a basis weight of between 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls.

The dewatered web is then further pressed and dried by a stream drum apparatus known in the art as a Yankee dryer. Pressure can be developed at the Yankee dryer by mechanical means such as an opposing cylindrical drum pressing against the web. Vacuum may also be applied to the web as it is pressed against the Yankee surface. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial overall mechanical compressional forces while the fibers are moist and are then dried (and optionally creped) while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987; all of which are incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and in softness.

The tissue paper web of this invention can be used in any application where soft, absorbent tissue paper webs are required. Particularly advantageous uses of the tissue paper web of this invention are in paper towel, toilet tissue and facial tissue products. For example, two tissue paper webs of this invention can be embossed and adhesively secured together in face to face relation as taught by U.S. Pat. No. 3,414,459, which issued to Wells on Dec. 3, 1968 and which is incorporated herein by reference, to form 2-ply paper towels.

Analytical and Testing Procedures

Analysis of the amount of biodegradable treatment chemicals used herein or retained on tissue paper webs can be performed by any method accepted in the applicable art.

A. Quantitative analysis for ester-functional quaternary ammonium compound

For example, the level of the ester-functional quaternary ammonium compounds, such as diester dioleyldimethyl ammonium chloride (DEDODMAC), diester dierucyldimethyl ammonium chloride (DEDEDMAC) retained by the tissue paper can be determined by solvent extraction of the DEDODMAC / DEDEDMAC by an organic solvent followed by an anionic/cationic titration using Dimidium Bromide as indicator. These methods are exemplary, and are not meant to exclude other methods which may be useful for determining levels of particular components retained by the tissue paper.

B. Hydrophilicity (absorbency)

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time". In order to provide a consistent and repeatable test for wetting time, the following procedure may be used for wetting time determinations: first, a conditioned sample unit sheet (the environmental conditions for testing of paper samples are 23±1° C. and 50+2% R.H. as specified in TAPPI Method T 402), approximately $4\frac{3}{8}$ inch×$4\frac{3}{4}$ inch (about 11.1 cm×12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 23±1° C. and a timer is simultaneously started; fourth, the timer is stopped and read when wetting of the balled sheet is completed. Complete wetting is observed visually.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the wetting times are preferably measured at the end of such two week period. Accordingly, wetting times measured at the end of a two week aging period at room temperature are referred to as "two week wetting times."

C. Density

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 $g/in^2$ (15.5 $g/cm^2$).

Optional Ingredients

Other chemicals commonly used in papermaking can be added to the biodegradable chemical softening composition described herein, or to the papermaking furnish so long as they do not significantly and adversely affect the softening, absorbency of the fibrous material, and softness enhancing actions of the biodegradable ester-functional quaternary ammonium softening compounds of the present invention.

A. Wetting Agents:

The present invention may contain as an optional ingredient from about 0.005% to about 3.0%, more preferably from about 0.03% to 1.0% by weight, on a dry fiber basis of a wetting agent.

(1 ) Polyhydroxy compounds

Examples of water soluble polyhydroxy compounds that can be used as wetting agents in the present invention include glycerol, polyglycerols having a weight average molecular weight of from about 150 to about 800 and polyoxyethylene glycols and polyoxypropylene glycols having a weight-average molecular weight of from about 200 to about 4000, preferably from about 200 to about 1000, most preferably from about 200 to about 600. Polyoxyethylene glycols having an weight average molecular weight of from about 200 to about 600 are especially preferred. Mixtures of the above-described polyhydroxy compounds may also be used. A particularly preferred polyhydroxy compound is polyoxyethylene glycol having an weight average molecular weight of about 400. This material is available commercially from the Union Carbide Company of Danbury, Conn. under the tradename "PEG-400".

(2) Nonionic Surfactant (Alkoxylated Materials)

Suitable nonionic surfactants can be used as wetting agents in the present invention include addition products of ethylene oxide and, optionally, propylene oxide, with fatty alcohols, fatty acids, fatty amines, etc.

Any of the alkoxylated materials of the particular type described hereinafter can be used as the nonionic surfactant. Suitable compounds are substantially water-soluble surfactants of the general formula:

$$R^2—y—(C_2H_4O)_z—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R^2$, and R, when present, have the meanings given hereinbefore, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

Linear Alkoxylated Alcohols a. Linear, Primary Alcohol Alkoxylates

The deca-, undeca-, dodeca-, tetradeca-, and pentadecaethoxylates of n-hexadecanol, and n-octadecanol having an HLB within the range recited herein are useful wetting agents in the context of this invention. Exemplary ethoxylated primary alcohols useful herein as the viscosity/dispensability modifiers of the compositions are n—$C_{18}$EO(10); and n—$C_{10}$EO(11). The ethoxylates of mixed natural or synthetic alcohols in the "oleic" chain length range are also useful herein. Specific examples of such materials include oleicalcohol-EO(11), oleicalcohol-EO(18), and oleicalcohol-EO(25).

b. Linear, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein can be used as wetting agents in the present invention. Exemplary ethoxylated secondary alcohols can be used as wetting agents in the present invention are: 2-$C_{16}$EO(11); 2-$C_{20}$EO(11); and 2-$C_{16}$EO(14).

Linear Alkyl Phenoxylated Alcohols

As in the case of the alcohol alkoxylates, the hexa- through octadecaethoxylates of alkylated phenols, particularly monohydric alkylphenols, having an HLB within the range recited herein are useful as the viscosity/dispensability modifiers of the instant compositions. The hexa- through octadeca-ethoxylates of p-tridecylphenol, m-pentadecylphenol, and the like, are useful herein. Exemplary ethoxylated alkylphenols useful as the wetting agents of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately hereinabove can be ethoxylated to an HLB within the range recited herein can be used as wetting agents in the present invention.

Branched Chain Alkoxylates

Branched chain primary and secondary alcohols which are available from the well-known "OXO" process can be ethoxylated and can be used as wetting agents in the present invention.

The above ethoxylated nonionic surfactants are useful in the present compositions alone or in combination, and the term "nonionic surfactant" encompasses mixed nonionic surface active agents.

The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as pegosperse 200 ML available from Glyco Chemicals, Inc. (Greenwich, Conn.) and IGEPAL RC-520 available from Rhone Poulenc Corporation (Cranbury, N.J.).

B. Strength additives:

Other types of chemicals which may be added, include the strength additives to increase the dry tensile strength and the wet burst of the tissue webs. The present invention may contain as an optional component from about 0.01% to about 3.0%, more preferably from about 0.3% to about 1.5% by weight, on a dry fiber weight basis, of a water-soluble strength additive resin.

(a) Dry strength additives

Examples of dry strength additives include carboxymethyl cellulose, and cationic polymers from the ACCO chemical family such as ACCO 711 and ACCO 514, with ACCO chemical family being preferred. These materials are available commercially from the American Cyanamid Company of Wayne, N.J.

(b) Permanent wet strength additives

Permanent wet strength resins useful herein can be of several types. Generally, those resins which have previously found and which will hereafter find utility in the papermaking art are useful herein. Numerous examples are shown in the aforementioned paper by Westfelt, incorporated herein by reference.

In the usual case, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further, some resins are soluble only under specific conditions, such as over a limited pH range.

Wet strength resins are generally believed to undergo a cross-linking or other curing reactions after they have been deposited on, within, or among the papermaking fibers. Cross-linking or curing does not normally occur so long as substantial amounts of water are present.

Of particular utility are the various polyamide-epichlorohydrin resins. These materials are low molecular weight polymers provided with reactive functional groups such as amino, epoxy, and azetidinium groups. The patent literature is replete with descriptions of processes for making such materials. U.S. Pat. No. 3,700,623, issued to Keim on Oct. 24, 1972 and U.S. Pat. No. 3,772,076, issued to Keim on Nov. 13, 1973 are examples of such patents and both are incorporated herein by reference.

Polyamide-epichlorohydrin resins sold under the trademarks Kymene 557H and Kymene 2064 by Hercules Incorporated of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Res 31, by Monsanto Company of St. Louis, Mo. These types of materials are generally described in U.S. Pat. Nos. 3,855,158 issued to Petrovich on Dec. 17, 1974; 3,899,388 issued to Petrovich on Aug. 12, 1975; 4,129,528 issued to Petrovich on Dec. 12, 1978; 4,147,586 issued to Petrovich on Apr. 3, 1979; and 4,222,921 issued to Van Eenam on Sep. 16, 1980, all incorporated herein by reference.

Other water-soluble cationic resins useful herein are the polyacrylamide resins such as those sold under the Parez trademark, such as Parez 631NC, by American Cyanamid Company of Stanford, Conn. These materials are generally described in U.S. Pat. Nos. 3,556,932 issued to Coscia et al. on Jan. 19, 1971; and 3,556,933 issued to Williams et al. on Jan. 19, 1971, all incorporated herein by reference.

Other types of water-soluble resins useful in the present invention include acrylic emulsions and artionic styrene-butadiene latexes. Numerous examples of these types of resins are provided in U.S. Pat. No. 3,844,880, Meisel, Jr. et al., issued Oct. 29, 1974, incorporated herein by reference.

Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to nitrogen.

Although less preferred, polyethylenimine type resins find utility in the present invention.

More complete descriptions of the aforementioned water-soluble resins, including their manufacture, can be found in TAPPI Monograph Series No. 29, Wet Strength In Paper and Paperboard, Technical Association of the Pulp and Paper Industry (New York; 1965), incorporated herein by reference. As used herein, the term permanent wet strength resin" refers to a resin which allows the paper sheet, when placed in an aqueous medium, to keep a majority of its initial wet strength for a period of time greater than at least two minutes.

(c) Temporary wet strength additives

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties. More recently, manufacturers have added temporary wet strength additives to paper products for which wet strength is sufficient for the intended use, but which then decays upon soaking in water. Decay of the wet strength facilitates flow of the paper product through septic systems.

Examples of suitable temporary wet strength resins include modified starch temporary wet strength agents, such as National Starch 78-0080, marketed by the National Starch and Chemical Corporation (New York, N.Y.). This type of wet strength agent can be made by reacting dimethoxyethyl-N-methyl-chloroacetamide with cationic starch polymers. Modified starch temporary wet strength agents are also described in U.S. Pat. No. 4,675,394, Solarek, et al., issued Jun. 23, 1987, and incorporated herein by reference. Preferred temporary wet strength resins include those described in U.S. Pat. No. 4,981,557, Bjorkquist, issued Jan. 1, 1991, and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

The above listings of optional chemical additives is intended to be merely exemplary in nature, and are not meant to limit the scope of the invention.

The following examples illustrate the practice of the present invention but are not intended to be limiting thereof.

EXAMPLE 1

The purpose of this example is to illustrate a method that can be used to make-up an aqueous dispersion of the biodegradable vegetable oil based ester-functional quaternary ammonium compound (e.g., diester dioleyldimethyl ammonium chloride (DEDODMAC) or diester dierucyldimethyl ammonium chloride (DEDEDMAC)).

A 2% dispersion of the DEDODMAC is prepared according to the following procedure: 1. A known weight of the DEDODMAC is measured; 2. The DEDODMAC is heated up to about 50° C. (122° F.); 3. The dilution water is preconditioned at pH~3 and at about 50° C. (122° F.); 4. Adequate mixing is provided to form an aqueous sub-micron dispersion of the DEDODMAC softening composition. 5. The particle size of the vesicle dispersion is determined using an optical microscopic technique. The particle size range is from about 0.1 to 1.0 micron.

A 2% dispersion of the DEDEDMAC is prepared according to the following procedure: 1. A known weight of the DEDEDMAC is measured; 2. The DEDEDMAC is heated up to about 50° C. (122° F.); 3. The dilution water is preconditioned at pH~3 and at about 50° C. (122° F.); 4. Adequate mixing is provided to form an aqueous sub-micron dispersion of the DEDEDMAC softening composition. 5. The particle size of the vesicle dispersion is determined using an optical microscopic technique. The particle size range is from about 0.1 to 1.0 micron.

EXAMPLE 2

The purpose of this example is to illustrate a method using a blow through drying papermaking technique to make soft and absorbent paper towel sheets treated with a biodegradable chemical softener composition of a vegetable oil based diester quat softeners (DEDODMAC) and a permanent wet strength resin.

A pilot scale Fourdrinier papermaking machine is used in the practice of the present invention. First, a 1% solution of the biodegradable chemical softener is prepared according to the procedure in Example 1. Second, a 3% by weight aqueous slurry of NSK is made up in a conventional re-pulper. The NSK slurry is refined gently and a 2% solution of a permanent wet strength resin (i.e. Kymene 557H marketed by Hercules incorporated of Wilmington, Del.) is added to the NSK stock pipe at a rate of 1% by weight of the dry fibers. The adsorption of Kymene 557H to NSK is enhanced by an in-line mixer. A 1% solution of Carboxy Methyl Cellulose (CMC) is added after the in-line mixer at a rate of 0.2% by weight of the dry fibers to enhance the dry strength of the fibrous substrate. The adsorption of CMC to NSK can be enhanced by an in-line mixer. Then, a 1% solution of the chemical softener (DEDODMAC) is added to the NSK slurry at a rate of 0.1% by weight of the dry fibers. The adsorption of the chemical softener mixture to NSK can also enhanced via an in-line mixer. The NSK slurry is diluted to 0.2% by the fan pump. Third, a 3% by weight aqueous slurry of CTMP is made up in a conventional re-pulper. A non-ionic surfactant (Pegosperse) is added to the re-pulper at a rate of 0.2% by weight of dry fibers. A 1% solution of the chemical softener mixture is added to the CTMP stock pipe before the stock pump at a rate of 0.1% by weight of the dry fibers. The adsorption of the chemical softener mixture to CTMP can be enhanced by an in-line mixer. The CTMP slurry is diluted to 0.2% by the fan pump. The treated furnish mixture (NSK/CTMP) is blended in the head box and deposited onto a Fourdrinier wire to form an embryonic web. Dewatering occurs through the Fourdrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 22% at the point of transfer, to a photo-polymer fabric having 240 Linear Idaho cells per square inch, 34 percent knuckle areas and 14 mils of photopolymer depth. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

Two plies of the web are formed into paper towel products by embossing and laminating them together using PVA adhesive. The paper towel has about 26 #/3M Sq Ft basis weight, contains about 0.2% of the biodegradable chemical softener (DEDODMAC) and about 1.0% of the permanent wet strength resin. The resulting paper towel is soft, absorbent, and very strong when wetted.

EXAMPLE 3

The purpose of this example is to illustrate a method using a blow through drying and layered papermaking techniques to make soft and absorbent toilet tissue paper treated with a biodegradable chemical softener composition of a vegetable oil based diester quat softener (DEDEDMAC) and a temporary wet strength resin.

A pilot scale Fourdrinier papermaking machine is used in the practice of the present invention. First, a 1% solution of the biodegradable chemical softener is prepared according to the procedure in Example 1. Second, a 3% by weight aqueous slurry of NSK is made up in a conventional re-pulper. The NSK slurry is refined gently and a 2% solution of the temporary wet strength resin (i.e. National starch 78-0080 marketed by National Starch and Chemical corporation of New York, N.Y.) is added to the NSK stock pipe at a rate of 0.75% by weight of the dry fibers. The adsorption of the temporary wet strength resin onto NSK fibers is enhanced by an in-line mixer. The NSK slurry is diluted to about 0.2% consistency at the fan pump. Third, a 3% by weight aqueous slurry of Eucalyptus fibers is made up in a conventional re-pulper. A 1% solution of the chemical softener mixture is added to the Eucalyptus stock pipe before the stock pump at a rate of 0.2% by weight of the dry fibers. The adsorption of the biodegradable chemical softener mixture to Eucalyptus fibers can be enhanced by an in-line mixer. The Eucalyptus slurry is diluted to about 0.2% consistency at the fan pump.

The treated furnish mixture (30% of NSK / 70% of Eucalyptus) is blended in the head box and deposited onto a Fourdrinier wire to form an embryonic web. Dewatering occurs through the Fourdrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the photo-polymer wire, at a fiber consistency of about 15% at the point of transfer, to a photo-polymer fabric having 562 Linear Idaho cells per square inch, 40 percent knuckle area and 9 mils of photo-polymer depth. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

The web is converted into a one ply tissue paper product. The tissue paper has about 18 #/3M Sq Ft basis weight, contains about 0.1% of the biodegradable chemical softener (DEDEDMAC) and about 0.2% of the temporary wet strength resin. Importantly, the resulting tissue paper is soft, absorbent and is suitable for use as facial and/or toilet tissues.

EXAMPLE 4

The purpose of this example is to illustrate a method using a blow through drying papermaking technique to make soft and absorbent toilet tissue paper treated with a biodegradable vegetable oil based diester quat softener (DEDEDMAC) and a dry strength additive resin.

A pilot scale Fourdrinier papermaking machine is used in the practice of the present invention. First, a 1% solution of the biodegradable chemical softener is prepared according to the procedure in Example 1. Second, a 3% by weight aqueous slurry of NSK is made up in a conventional re-pulper. The NSK slurry is refined gently and a 2% solution of the dry strength resin (i.e. ACCO 514, ACCO 711 marketed by American Cyanamid company of Fairfield, Ohio) is added to the NSK stock pipe at a rate of 0.2% by weight of the dry fibers. The adsorption of the dry strength resin onto NSK fibers is enhanced by an in-line mixer. The NSK slurry is diluted to about 0.2% consistency at the fan pump. Third, a 3% by weight aqueous slurry of Eucalyptus fibers is made up in a conventional re-pulper. A 1% solution of the chemical softener mixture is added to the Eucalyptus stock pipe before the stock pump at a rate of 0.2% by weight of the dry fibers. The adsorption of the biodegradable chemical softener to Eucalyptus fibers can be enhanced by an in-line mixer. The Eucalyptus slurry is diluted to about 0.2% consistency at the fan pump.

The treated furnish mixture (30% of NSK / 70% of Eucalyptus) is blended in the head box and deposited onto a Fourdrinier wire to form an embryonic web. Dewatering occurs through the Fourdrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the photo-polymer wire, at a fiber consistency of about 15% at the point of transfer, to a photo-polymer fabric having 562 Linear Idaho cells per square inch, 40 percent knuckle area and 9 mils of photo-polymer depth. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

Two plies of the web are formed into tissue paper products and laminating them together using ply bonded technique. The tissue paper has about 23 #/3M Sq Ft basis weight, contains about 0.1% of the biodegradable chemical softener (DEDEDMAC) and about 0.1% of the dry strength resin. Importantly, the resulting tissue paper is soft, absorbent and is suitable for use as facial and/or toilet tissues.

EXAMPLE 5

The purpose of this example is to illustrate a method using a conventional drying papermaking technique to make soft and absorbent toilet tissue paper treated with a biodegradable vegetable oil based diester quat softener (DEDEDMAC) and a dry strength additive resin.

A pilot scale Fourdrinier papermaking machine is used in the practice of the present invention. First, a 1% solution of the biodegradable chemical softener is prepared according to the procedure in example 3. Second, a 3% by weight aqueous slurry of NSK is made up in a conventional re-pulper. The NSK slurry is refined gently and a 2% solution of the dry strength resin (i.e. ACCO 514, ACCO 711 marketed by American Cyanamid company of Wayne, N.J.) is added to the NSK stock pipe at a rate of 0.2% by weight of the dry fibers. The adsorption of the dry strength resin onto NSK fibers is enhanced by an in-line mixer. The NSK slurry is diluted to about 0.2% consistency at the fan pump. Third, a 3% by weight aqueous slurry of Eucalyptus fibers is made up in a conventional repulper. A 1% solution of the chemical softener mixture is added to the Eucalyptus stock pipe before the stock pump at a rate of 0.2% by weight of the dry fibers. The adsorption of the chemical softener mixture to Eucalyptus fibers can be enhanced by an in-line mixer. The Eucalyptus slurry is diluted to about 0.2% consistency at the fan pump.

The treated furnish mixture (30% of NSK / 70% of Eucalyptus) is blended in the head box and deposited onto a Fourdrinier wire to form an embryonic web. Dewatering occurs through the Fourdrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 15% at the point of transfer, to a conventional felt. Further dewatering is accomplished by vacuum assisted drainage until the web has a fiber consistency of about 35%. The web is then adhered to the surface of a Yankee dryer. The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

Two plies of the web are formed into tissue paper products and laminating them together using ply bonded technique. The tissue paper has about 23#/3M Sq Ft basis weight, contains about 0.1% of the biodegradable chemical softener (DEDEDMAC) and about 0.1% of the dry strength resin. Importantly, the resulting tissue paper is soft, absorbent and is suitable for use as a facial and/or toilet tissues.

What is claimed is:

1. A soft paper product comprising:

(a) cellulose paper making fibers; and (b) from about 0.005% to about 5.0% by weight of said cellulose paper making fibers of a biodegradable ester-functional quaternary ammonium softening compound having the formula:

$$(R)_{4-m}—N^+—[(CH_2)_n—Y—R^2]_m X^-$$

wherein each Y is —O—(O)C—, or —C(O)—O—;

m is 1 to 3;

n is 1 to 4;

each R is a $C_1$-$C_6$ alkyl group, hydroxyalkyl group, hydrocarbyl group, substituted hydrocarbyl group, benzyl group, or mixtures thereof;

each $R^2$ is a $C_{11}$-$C_{23}$ hydrocarbyl or substituted hydrocarbyl substituent; and $X^-$ is any softener-compatible anion;

wherein the $R^2$ portion of the softening compound is derived from $C_{12}$-$C_{24}$ fatty acyl groups having an Iodine Value of from greater than about 5 to less than about 100.

2. The paper product according to claim 1 wherein the majority of said fatty acyl groups are derived from vegetable oil sources.

3. The paper product according to claim 2 wherein the Iodine Value of said fatty acyl groups is from about 10 to about 85.

4. The paper product according to claim 3 wherein said fatty acyl groups have a cis/trans isomer weight ratio greater than about 50/50.

5. The paper product according to claim 3 wherein the majority of $R^2$ comprises fatty acyls containing at least 90% $C_{18}$-$C_{24}$ chain length.

6. The paper product according to claim 5 wherein the majority of $R^2$ comprises fatty acyls containing at least 90% $C_{18}$.

7. The paper product according to claim 5 wherein the majority of $R^2$ comprises fatty acyls containing at least 90% $C_{22}$.

8. The paper product according to claim 1 further comprising from about 0.005% to about 3.0% of a wetting agent.

9. The paper product according to claim 8 wherein said wetting agent is a water soluble polyhydroxy compound.

10. The paper product according to claim 8 wherein said wetting agent is a linear alkoxylated alcohol.

11. The paper product according to claim 8 wherein said wetting agent is a linear alkyl phenoxylated alcohol.

12. The paper product according to claim 2 wherein each R is a $C_1$-$C_3$ alkyl group.

13. The paper product according to claim 12 wherein each R is a methyl group.

14. The paper product according to claim 2 wherein m=2 and wherein n=2.

15. The paper product according to claim 3 wherein the level of polyunsaturates of the fatty acyl groups is less than about 30%.

16. The paper product according to claim 15 wherein the level of polyunsaturates of the fatty acyl groups is less than about 10%.

17. The paper product according to claim 12 wherein $X^-$ is selected from the group consisting of chloride, acetate, methyl sulfate, and mixtures thereof.

18. The paper product according to claim 6 wherein the majority of said vegetable oil based fatty acyl groups are derived from olive oil.

19. The paper product according to claim 7 wherein the majority of said vegetable oil based fatty acyl groups are derived from rapeseed oil.

20. The paper product according to claim 6 wherein the majority of said vegetable oil based fatty acyl groups are derived from high oleic safflower oil.

21. The paper product according to claim 7 wherein the majority of said vegetable oil based fatty acyl groups are derived from meadow foam oil.

22. The paper product according to claim 1 wherein said paper product is a paper towel.

23. The paper product according to claim 1 wherein said paper product is a facial tissue.

24. The paper product according to claim 1 wherein said paper product is a toilet tissue.

* * * * *